US006980180B2

(12) United States Patent
Hasagawa

(10) Patent No.: US 6,980,180 B2
(45) Date of Patent: Dec. 27, 2005

(54) ORGANIC EL DISPLAY APPARATUS AND METHOD OF CONTROLLING THE SAME

(75) Inventor: Hiroshi Hasagawa, Tokyo (JP)

(73) Assignee: Sony Corporation, Tokyo (JP)

( * ) Notice: Subject to any disclaimer, the term of this patent is extended or adjusted under 35 U.S.C. 154(b) by 429 days.

(21) Appl. No.: 10/355,890

(22) Filed: Jan. 31, 2003

(65) Prior Publication Data

US 2003/0218583 A1 Nov. 27, 2003

(30) Foreign Application Priority Data

Feb. 4, 2002 (JP) ..... 2002-026251

(51) Int. Cl.[7] ..... G09G 3/30; G09G 5/00
(52) U.S. Cl. ..... 345/77; 345/204
(58) Field of Search ..... 345/204, 205, 345/206, 76, 77, 80

(56) References Cited

U.S. PATENT DOCUMENTS 6,175,351 B1 * 1/2001 Matsuura et al. ..... 345/98
6,380,943 B1 * 4/2002 Morita et al. ..... 345/589
6,388,644 B1 * 5/2002 De Zwart et al. ..... 345/60
6,583,775 B1 * 6/2003 Sekiya et al. ..... 345/76
6,661,428 B1 * 12/2003 Kim ..... 345/690
2001/0035863 A1 * 11/2001 Kimura ..... 345/205
2002/0003522 A1 * 1/2002 Baba et al. ..... 345/89
2002/0030671 A1 * 3/2002 Shigeta et al. ..... 345/204
2002/0084967 A1 * 7/2002 Akimoto et al. ..... 345/90

* cited by examiner

*Primary Examiner*—Ryan Yang
(74) *Attorney, Agent, or Firm*—Robert J. Depke; Trexler, Bushnell, Giangiorgi, Blackstone & Marr

(57) ABSTRACT

An organic EL display having organic EL elements disposed in a matrix as luminescent pixels is provided, comprised of a summation data detection unit for detecting a summation signal level of a respective original source signal to drive a respective luminescent pixel, and a panel control unit for controlling a luminescing period of the respective luminescent pixel in accordance with a summation signal level (digitally, a summation data) corresponding to one field (one frame). The panel control unit with a built-in lookup table for converting the summation data of one field to luminescing periods determines a luminescing period of respective organic EL elements in response to the summation data corresponding to one field by referring to the lookup table. Thereby, contradicting conditions for improving contrast and reducing power consumption are satisfied simultaneously without depending on the properties of the organic EL elements.

7 Claims, 6 Drawing Sheets

1 FIELD DATA : HOR . 4POINTS × VER . 4POINTS = 16POINTS
4BIT × 16POINT = 256

ORGANIC EL DISPLAY APPARATUS AND METHOD OF CONTROLLING THE SAME

This application claims priority to Japanese Patent Application Number JP2002-026251 filed Feb. 4, 2002, which is incorporated herein by reference.

BACKGROUND OF THE INVENTION

1. Field of the Invention

The present invention relates to an organic electroluminescence (hereinafter, referred to as organic EL) display apparatus, and, in particular, to an organic EL display apparatus that uses electroluminescence elements made of an organic material as luminescing elements in luminescent pixels, and a method of controlling the same.

2. Description of the Related Art

A flat panel display with a thin and light body is expected to play a major role as a multimedia device in the future. Such a typical flat panel display may be a liquid crystal display, an organic EL display, or the like. At present, the most popular and widely applied flat panel display is the liquid crystal display. However, this liquid crystal display has some problems that may prevent further improvement of its display quality.

More specifically, it needs to increase its emission luminance in order to obtain a higher brightness because a conventional liquid crystal display requires a backlight. If the emission luminance of the backlight is increased, the display brightness of the conventional liquid crystal display increases. However, it is difficult to completely shield light of the backlight by the liquid crystals thereby causing deterioration of display performance of black color. Furthermore, because the maximum brightness of the liquid crystal display is determined by the backlight, its contrast is inevitably determined by the brightness of the backlight. Therefore, not alike a display using CRT, it is difficult to intentionally control its contrast and brightness by any method other than by means of input signals.

Furthermore, the liquid crystal display is of a type that holds information written into pixels for a period of time corresponding to one field. Accordingly, motion picture display quality of the liquid crystal display is inferior compared to that of the CRT. This is because that, while a light of display in the CRT is impulsive, a light of display in the liquid crystal display changes in a stepwise form basically due to the holding operation for one field period (in practice, it changes exponentially due to a response time of the device), thereby causing blurriness to be perceived when displaying the motion picture.

On the other hand, the organic EL display uses, as its luminescing (light-emitting) element in a luminescent pixel, an organic EL element that can yield a brightness of several hundreds to several tens thousands nit at a driving voltage equal to or less than 10 V. Further, because the organic EL display has such advantages that it is a self-luminescing type with no viewing angle dependency, has a high contrast ratio and an excellent motion picture display performance compared to that of the hold type display. Accordingly, it is expected to be a promising flat panel display of the next generation.

As a method of driving the organic EL display, a passive matrix method and an active matrix method are known. In order to realize a large-scaled and high-resolution display, in the case of the passive matrix method, because an luminescing period of each pixel decreases with an increasing number of scanning lines (i.e., the number of pixels in the vertical direction), it is required for a respective organic EL element in each pixel to luminesce instantaneously at a high brightness. On the other hand, in the case of the active matrix-addressed method, because each pixel maintains its luminescing for a period of one frame, it is easier to realize the large-scaled and high-resolution display.

SUMMARY OF THE INVENTION

In the active matrix-addressed organic EL display, as for the drive of the luminescent pixels, conventionally, they are always driven under a constant condition irrespective of a level of input signals (picture/video signals). Therefore, a question of whether or not the display can provide a higher brightness and higher contrast is closely related to properties of the organic EL elements. Furthermore, the properties of the organic EL elements closely control whether or not the display can be operated at a lower energy consumption. In addition, when a high voltage is maintained or a large current is continuously provided to the organic EL elements to obtain a high brightness, there arise such problems that performance of the organic EL elements is likely to deteriorate, and its power consumption increases further.

The present invention is contemplated to solve or alleviate the above-mentioned problems associated with the conventional technology. It is desirable to provide a novel organic EL display apparatus capable of realizing a higher contrast and lower power consumption without relying on the properties of the organic EL elements, and/or a control method for the organic EL display apparatus.

According to an embodiment of the present invention, there is provided an organic EL display apparatus having a plurality of organic EL elements, as luminescent pixels, arranged in a matrix form. The organic EL display apparatus includes: summation data detection means (e.g., summation data detection circuit) for obtaining the summation of signal level through detection of an original source signal, based on which the luminescent pixels are driven, and panel control means (e.g., panel control circuit) for controlling an luminescing time period for the luminescent pixels based on the summation of signal level (digitally, "summation data") corresponding to one field (one frame) and being supplied from the summation data detection means.

The panel control means may have a lookup table (LUT) for converting the summation data corresponding to one field into a luminescing time period, and may be configured to determine the luminescing time period of the organic EL elements on the basis of the summation data corresponding to one field by referring to the lookup table.

This type of control based on the signal level of the original source signal is a feedforward type control. In the feedforward type control, because the detection result of the signal level at present time can be reflected on the control of the luminescing time period in a subsequent field, the control with a minimum delay can be achieved. Further, because of the feedforward control thereof, each luminescing time period for each luminescent pixel can be controlled without being affected by properties of respective luminescing elements of R (red), G (green) and B (blue) therein.

BRIEF DESCRIPTION OF THE DRAWINGS

The above and other objects, features and advantages of the present invention will become more apparent from the following description of the presently preferred exemplary embodiment of the present invention taken in conjunction with the accompanying drawings, in which.

DETAILED DESCRIPTION OF THE EMBODIMENTS

By referring to the accompanying drawings, preferred embodiments of the present invention are described in detail.

Figure 1:
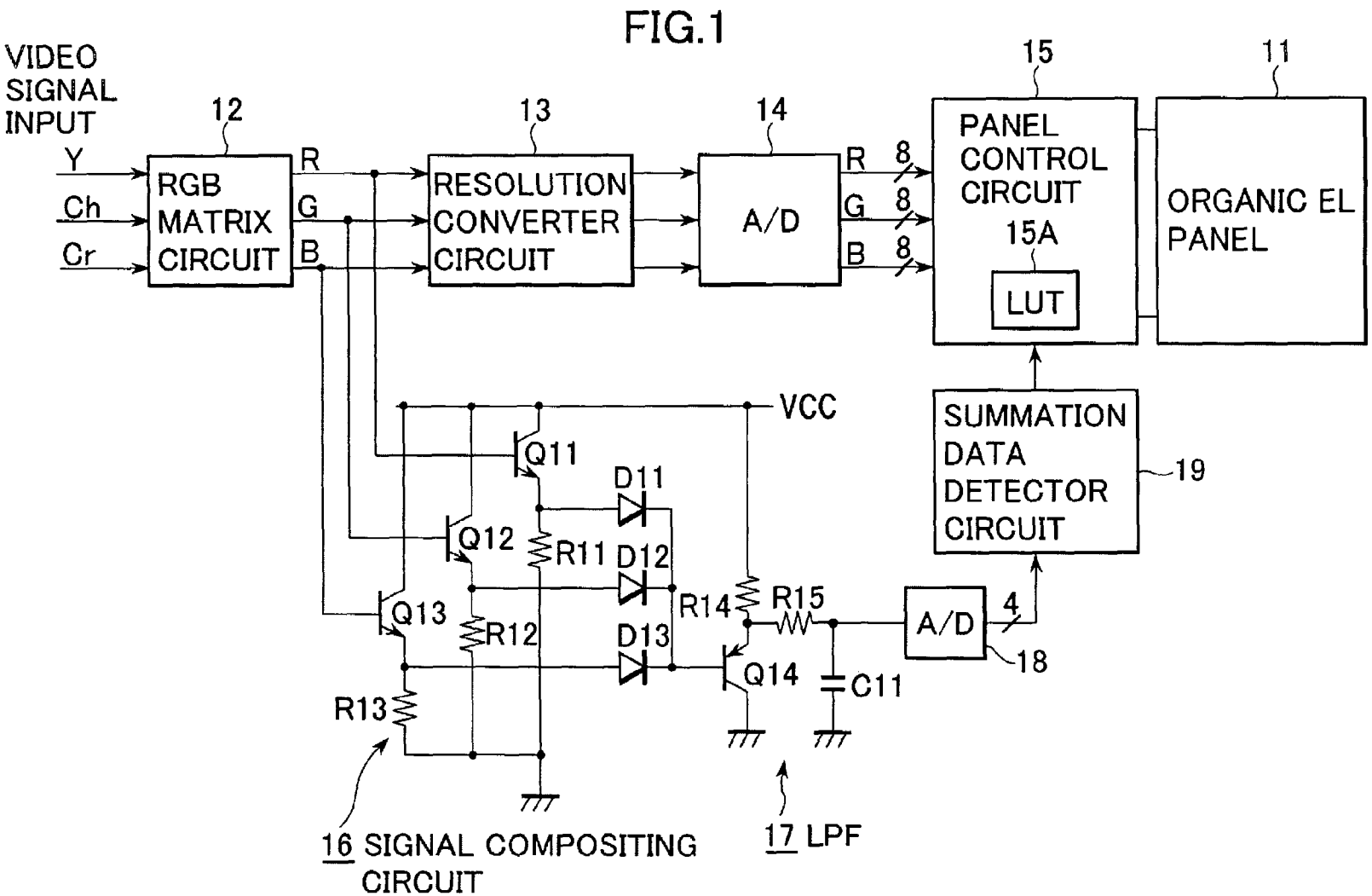
FIG. 1 is a block diagram depicting an organic EL display apparatus according to a first preferred embodiment of the present invention.

First Embodiment:

FIG. 1 is a block diagram showing an exemplary arrangement of an organic EL display apparatus according to one preferred embodiment of the present invention.

As clearly shown in FIG. 1, the organic EL display apparatus according to the present preferred embodiment is configured to include an organic EL panel 11, an RGB matrix circuit 12, a resolution conversion circuit 13, an A/D conversion circuit 14, a panel control circuit 15, a signal compositing circuit 16, a low pass filter (LPF) 17, an A/D conversion circuit 18, and a summation data detection circuit 19. Alternatively, the summation data detection circuit 19 may be integrated into the panel control circuit 15 so that the panel control circuit 15 has a function of the summation data detection circuit 19 as well.

The organic EL panel 11 has such a configuration that a plurality of pixel circuits including organic EL elements are arranged in a matrix form on a substrate such as a transparent glass. More specifically, the organic EL element includes a first electrode (e.g., anode) made of a transparent conducting film formed on the substrate, an organic layer which is formed by sequentially laminating a hole transport layer, a luminescent layer, an electron transport layer and an electron injection layer. Furthermore, a second electrode (e.g., cathode) made of a metal having a low work function is formed on the organic layer.

In the organic EL element, by applying a DC voltage across the first electrode (anode) and the second electrode (cathode), holes are injected from the first electrode (anode) into the luminescent layer via the hole transport layer and electrons are injected from the second electrode (cathode) into the luminescent layer via the electron transport layer, respectively. By these injected positive and negative carriers, fluorescent molecules in the luminescent layer are driven to an excited state, and in a relaxation process of the excited molecules, light emission is produced.

In a respective pixel circuit containing the organic EL element, typically, thin film transistors (TFT) are used as active elements. The pixel circuit in a typical configuration may include a plurality of TFTs and a capacitor for holding pixel information (luminance information).

Further, on the substrate of the organic EL panel 11, there are provided wiring in a matrix form. The matrix is configured from gate lines the number of which corresponds to the number of pixels in the vertical direction and data lines the number of which corresponds to the number of pixels in the horizontal direction. At respective intersections therebetween, respective pixel circuits containing the organic EL element are placed. Then, these pixel circuits are selected sequentially by a respective vertical scan circuit row by row, and to respective pixel circuits on each row thus selected are given luminance information from the panel control circuit 15 via the data line column by column. By selectively providing the luminance information from the data line via the driving TFTs to respective pixel circuits on each row thus selected, their organic EL elements are driven.

A luminance (brightness) signal Y and chrominance signals Cb, Cr are inputted to the RGB matrix circuit 12. The RGB matrix circuit 12 converts the luminance signal Y and the chrominance signals Cb, Cr to analog RGB signals. The analog RGB signals, after subjected to a resolution conversion processing so as to adjust to a resolution of the organic EL panel 11 (the number of dots in the vertical/horizontal directions) in the resolution conversion circuit 13, are converted to digital RGB signals, for example, of 8 bits in the A/D conversion circuit 14, and then supplied to the panel control circuit 15.

The analog RGB signals are also supplied to the signal compositing circuit 16 as an original source signal for driving the luminescent pixels. The signal compositing circuit 16 executes a process of compositing analog RGB signals in order to detect an overall signal level of the original source signal. This signal compositing circuit 16, for example, as shown in FIG. 1, is configured to have transistors Q11, Q12 and Q13, in which respective collectors thereof are coupled to a power source VCC and respective bases thereof are coupled to the analog RGB signals, resistors R11, R12 and R13 connected between a respective emitter of these transistors Q11, Q12 or Q13 and the ground, and diodes D11, D12 and D13, in which respective anodes thereof are coupled to respective emitters of the transistors Q11, Q12 or Q13 and respective cathodes thereof are coupled together.

An analog signal thus composited in the signal compositing circuit 16 is supplied to the A/D conversion circuit 18 via the LPF 17. The LPF 17 filters noise components and high frequency components contained in the analog signal so as to obtain an optimum signal band region, for example, of several hundreds Hz. The LPF 17, for example, as shown in FIG. 1, is configured to include a buffer portion which includes a resistance R14 and a transistor Q14 connected in series between the power source VCC and the ground, and a filter portion which includes a resistance R15 with one end thereof connected to the emitter of transistor Q14 and a capacitor C11 connected between the other end of the resistance R15 and the ground.

The analog signal having passed through the LPF 17 is converted to digital signal data, for example, of 4 bits in the A/D conversion circuit 18. As for the digital signal data, because data adjustment is possible in the panel control circuit 15 in a subsequent stage, precision of the digital signal data is not necessary to be very high. Further, as will be described below, because a sampling frequency in the A/D conversion circuit 18 is as low as approximately 1 kHz, the A/D conversion circuit 18 of 4 bits or so can be constructed at a relatively low cost using a general-purpose operational amplifier.

Figure 2:
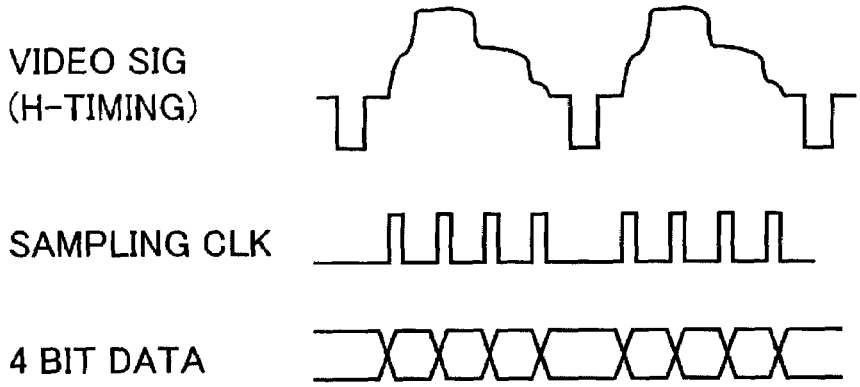
FIG. 2 is a timing chart depicting a sampling relation in one horizontal scan period of time.
Figure 3:
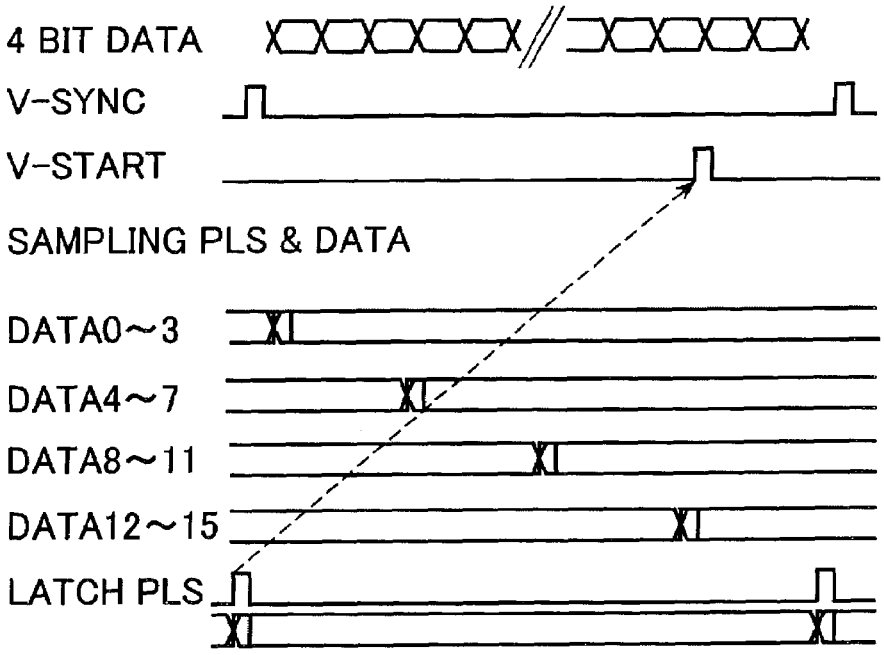
FIG. 3 is a timing chart depicting a mode of sampling at 16 points in one field.

In the A/D conversion circuit 18, for example, as shown in FIG. 2, sampling is made four times in one horizontal scan period (1 H). By repeating the sampling in the horizontal scan direction, and making sampling, for example, at four points in the vertical scan direction, 16 times samplings in one field (one frame) are executed as shown in FIG. 3. It should be noted, however, that the sampling method in the A/D conversion circuit 18 for making 16 times sampling in one field period is only an example, and therefore, it is possible to increase or decrease the number of sampling. Generally, with an increasing number of sampling, a finer control is enabled.

The sampled data in the A/D conversion circuit 18 is supplied to a summation data detection circuit 19. The summation data detection circuit 19 latches the sampled data supplied from the A/D conversion circuit 18, summates the data between vertical synchronous pulses (V-Sync), i.e., the data taken at 16 points within one field (one frame), thereby detecting summation data corresponding to one field, and supplies the summation data thus detected to the panel control circuit 15.

The panel control circuit 15 controls for respective luminescent pixels in the organic EL panel 11 which are scanned sequentially row by row to be selected such that each drive current corresponding to a signal level of digital RGB signals supplied from the A/D conversion circuit 14 is to flow through respective organic EL elements of RGB in respective luminescent pixels selected. Furthermore, the panel control circuit 15 controls the luminescing period of respective organic EL elements on the basis of the summation data corresponding to one field supplied from the summation data detection circuit 19.

Here, the control of the luminescing period on the basis of the summation data corresponding to one field will be described more specifically.

Figure 4:
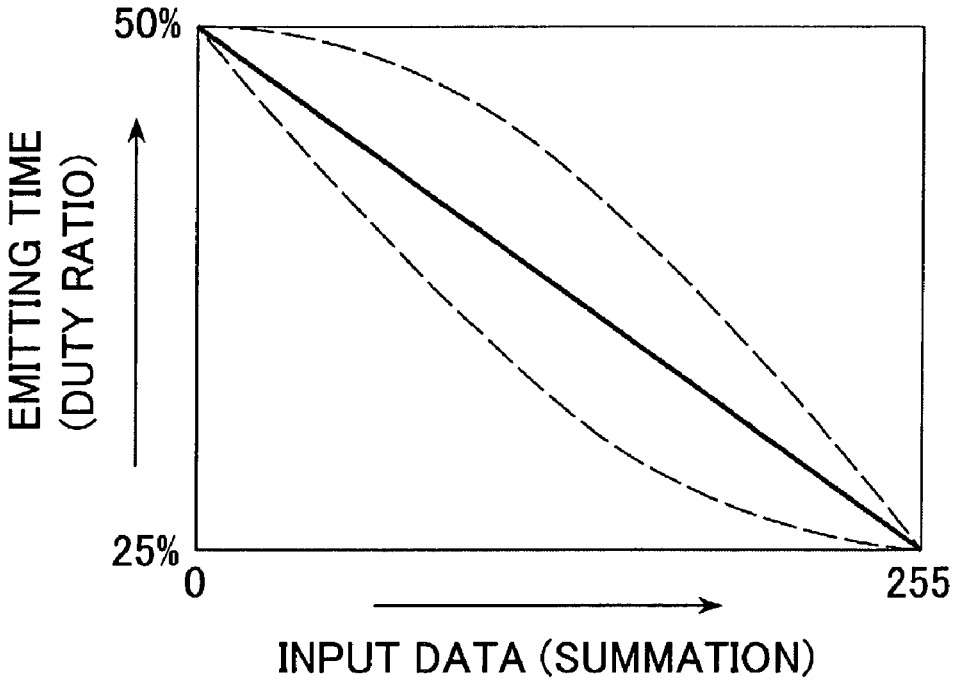
FIG. 4 is an input/output characteristic diagram depicting a relation of luminescing periods (duty ratio) versus input data in the lookup table (LUT)

The panel control circuit 15 has a built-in lookup table (LUT) 15A for converting the summation data corresponding to one field to an appropriate luminescing period. By referring to the lookup table 15A, the luminescing periods of the organic EL elements in accordance with the summation data corresponding to the one field is determined. In FIG. 4, the lookup table 15A is set up, as a standard mode in the present example, such that a linear relation as depicted by a solid line in the figure is obtained between the luminescing periods (duty ratio) and its input data (4 bit×16 sampling, in this instance example).

In the present preferred embodiment, the linear relation is set up in such a way that the duty ratio of the luminescing period becomes 50% when the summation data is minimum, and that the duty ratio of the luminescing period becomes 25% when the summation data is maximum. By setting the linear relationship between the summation data corresponding to one field and the luminescing periods as described above, advantageously, a design specification of the maximum peak brightness of 300 nit/whole white input brightness of 150 nit can be satisfied without deteriorating motion (video) picture display quality nor unpleasant changes in brightness.

Although in the present preferred embodiment, the lookup table 15A is set up as its standard mode to obtain the linearly converted luminescing period (duty ratio) relative to the input data, the present invention is not limited thereto, and another lookup table performing different mapping may be employed. For example, depending on various preferences toward picture qualities and/or different input sources, one of characteristic curves indicated by dotted lines in FIG. 4 may be used for the mapping of the input data to obtain the luminescing period (duty ratio).

Circuit operations of the organic EL display apparatus having the above-mentioned configuration according to the first preferred embodiment of the present invention will be described.

The luminance signal Y and the chrominance signals Cb, Cr are converted into analog RGB signals in the RGB matrix circuit 12. Then, in the resolution conversion circuit 13, the resolution is converted to conform to the resolution of the panel. Further, in the A/D conversion circuit 14, the RGB signals are converted into digital RGB signals, and supplied to the panel control circuit 15. Furthermore, the analog RGB signals from the RGB matrix circuit 12 are composited in the signal compositing circuit 16, filtered out its noise components and high frequency components in the LPF 17, converted to digital signal data in the A/D conversion circuit 18, and supplied to the summation detection circuit 19.

The summation data detection circuit 19 latches the data obtained by sampling in the A/D conversion circuit 18 thereby detecting the summation data corresponding to one field (one frame) by summating these data, for example, corresponding to 16 points. The summation data thus detected is supplied to the panel control circuit 15.

The panel control circuit 15 controls the respective organic EL elements in such a way that, by sequentially scanning respective luminescent pixels to be selected in the organic EL panel 11 row by row, each organic EL element of RGB in a respective luminescent pixel thus selected is driven by the drive current in accordance with the signal level of the digital RGB signals. Furthermore, the panel control circuit 15 controls the luminescing period of the respective organic EL elements by referring to the lookup table 15A based on the summation data corresponding to one field supplied from the summation detection circuit 19.

As hereinabove described, in the organic EL display apparatus including the plurality of luminescent pixels, which are arranged in the matrix form and respectively contain organic EL elements, the signal levels of the analog video signals that are the original source signals are detected, and on the basis of the detected signal level, the luminescing periods of respective organic EL elements is controlled. By appropriately combining a luminescing period and a non-luminescing period of the organic EL element, the enhancement of contrast and reduction of power consumption, which are mutually contradicting conditions in the conventional technology, can be perused at the same time without relying on the properties of the organic EL elements.

Specifically, more impressive picture images that have an enhanced contrast can be displayed on a display screen by setting a longer luminescing time period for a darker screen image having less (summation) input data as shown in FIG. 4 and by causing the organic EL elements to luminesce at a higher brightness. Further, if the screen image is brighter as its input data (summation data) is large, the luminance of the organic EL elements is reduced so that an exothermic reaction in the organic EL elements and/or deterioration thereof due to an excessive drive current are suppressed without impairing the quality of display, thereby providing the organic EL display apparatus featuring an improved service life.

In particular, because the method of control based on the signal level of the analog video signals is the type of feedforward control, the results of detection of the summation data corresponding to one field can be reflected on the control of luminescing periods of respective EL elements in the subsequent field, an improved control featuring least delay can be realized. More specifically, because the detected summation data is reflected upon the subsequent field control, the delay time is only one field period, which is only 16.7 msec assuming that its vertical scan frequency is set to, for example, 60 Hz.

In a typical TV receiver using a CRT, an automatic brightness limiter (ABL) control method is used. This ABL control method is originally used for preventing an increase of a beam spot diameter due to an over current and/or an excessive load of horizontal deflection. The ABL control method also plays an important role in improving the display contrast and reducing the power consumption.

However, according to the ABL control method, because that the total current flowing through the cathode is detected and a beam current is controlled by its feedback control, a stabilization period for a transient response may takes about 200 msec. Accordingly, in such a rapid change from a bright scene to a dark scene or vice versa, a certain response delay will be visually perceived, thereby resulting in choppy or incongruent images more or less.

In contrast, in the organic EL display apparatus according to the present embodiment, the response delay is advantageously controlled within about 16.7 msec because of the feedforward control method as described above. Furthermore, the response speed is a normal response speed of the typical liquid crystal display (LCD), thereby causing no visual unpleasantness.

In addition, because the feedforward control of the present embodiment is based on the original source signals, respective luminescing periods of the organic EL elements of RGB can be controlled without being affected by their properties. In other words, luminous efficiency of the organic EL element differs depending on R, G and B. Accordingly, in the case of the feedback control, if any one specific color has an extremely low luminous efficiency, an adequate average luminescing quantity cannot be obtained. Therefore, precise control cannot be executed. In contrast, according to the feedforward control of the present invention, the precise control of the luminescing periods can be achieved since individual luminous efficiencies of the organic EL elements does not produce any influence on the control procedure, which is performed on the basis of the original source signals.

Furthermore, in the present preferred embodiment described above, the analog RGB signals are inputted to the LPF 17 after compositing them in the signal compositing circuit 16 because the analog RGB signals are used as the original source signals. Alternatively, it is also possible to use composite video signals and/or component Y signals as the original source signals. In such cases, because the signal compositing circuit 16 is not required, it may be arranged in such a way that the composite video signals and/or component Y signals (brightness signal Y of chrominance signals) are directly inputted into the LPF 17. It is also necessary to change constants of the LPF 17 (a value of resistance R15, capacitance of capacitor C11, etc.) in response to an input signal to be inputted.

Second Embodiment

Figure 5:
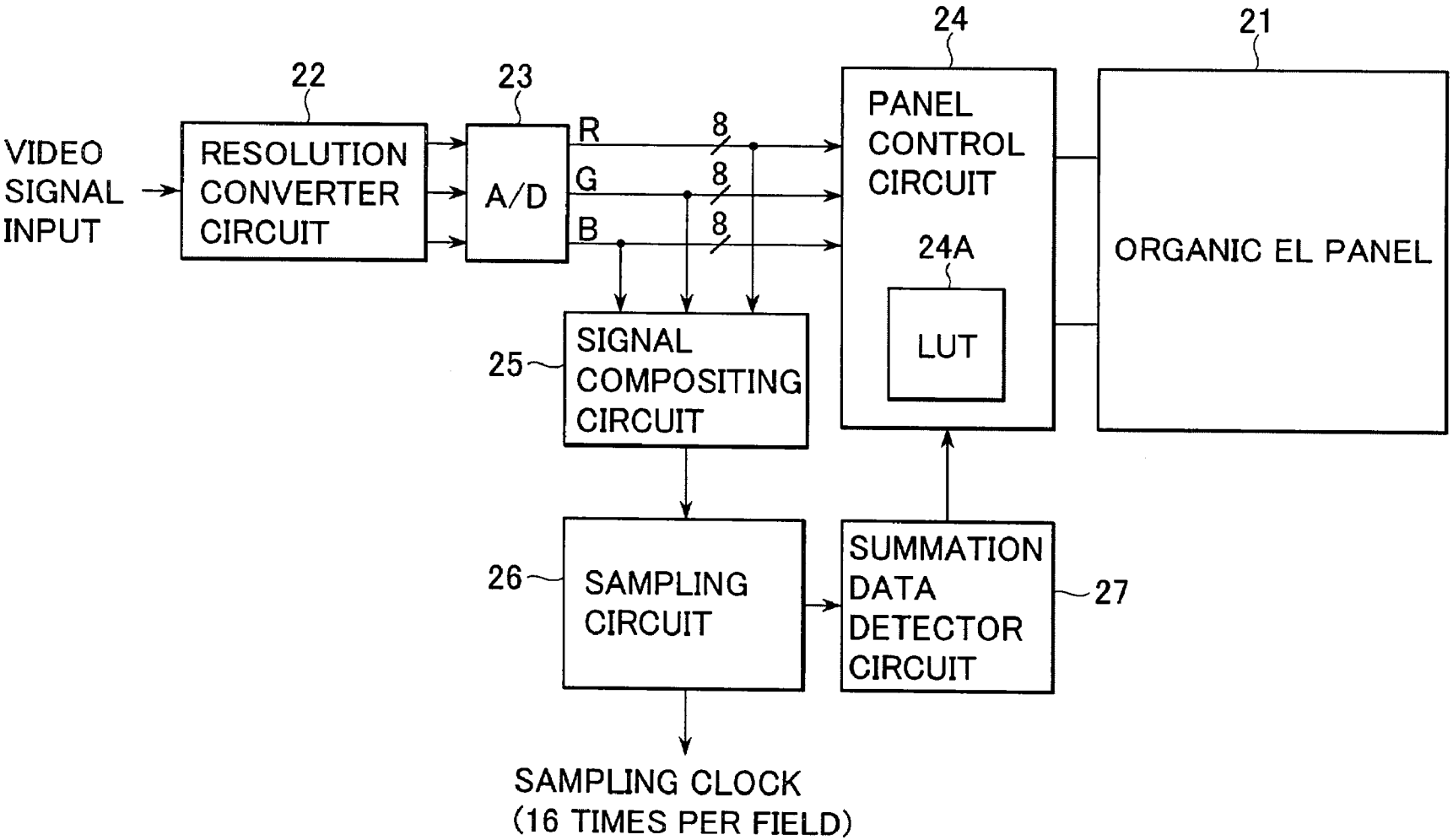
FIG. 5 is a block diagram depicting an exemplary configuration of an organic EL display apparatus according to a second embodiment of the present invention.

FIG. 5 is a schematic block diagram showing a configuration of an organic EL display apparatus according to the second preferred embodiment of the present invention.

As clearly shown in FIG. 5, the organic EL display apparatus according to the second embodiment of the present invention is configured to include an organic EL panel 21, a resolution conversion circuit 22, an A/D conversion circuit 23, a panel control circuit 24, a signal compositing circuit (adder circuit) 25, a sampling circuit 26 and a summation data detection circuit 27. By way of example, as for the signal compositing circuit 25, the sampling circuit 26 and the summation data detection circuit 27, they may be integrated into the panel control circuit 24 so that the panel control circuit 24 is given respective functions of the adder circuit 25, the sampling circuit 26 and the summation data detection circuit 27.

The organic EL panel 21, likewise the organic EL panel 11 in the organic EL display apparatus according to the first embodiment of the present invention, has an arrangement in which a plurality of pixel circuits each containing respective organic EL elements are arranged in a matrix form on a substrate such as a transparent glass. To the resolution conversion circuit 22 is inputted an analog video signal. This analog video signal is supplied to the panel control circuit 24 after subjected to a resolution conversion processing in the resolution conversion circuit 22 for adjustment of the resolution of the organic EL panel 21 and conversion to digital RGB signals, for example, of 8 bits in the A/D conversion circuit 23.

The digital RGB signals of 8 bits are also supplied to the signal compositing circuit 25 as an original source signal to drive the luminescent elements. The signal compositing circuit 25 executes a compositing process to add up the upper 4 bits of the digital RGB signals of 8 bits. For the data obtained by compositing in the signal compositing circuit 25, sampling is performed in a sampling circuit 26, likewise in the case of the first embodiment, between vertical synchronous pulses (V-Sync), i.e., 16 times in one field.

It should be noted that the sampling method in the sampling circuit 26, namely, 16 times of sampling in one field period is only an example, and it is possible to increase or decrease the number of sampling. With an increasing number of sampling, further finer control is enabled. If all of the 8 bit signal data are sampled as they are the volume of data will become enormous. Therefore, in this embodiment of the present invention, only the upper 4 bits are subjected to the signal compositing processing in the signal compositing circuit 25 so that only the upper 4 bits thereof are sampled.

Further, in the case of the digital data, because an optimum filtering is not provided, it is necessary to calculate an average value over an extent as broader as possible in the vicinity of a pixel point of sampling. Here, in the resolution conversion circuit 22, there is normally incorporated an interpolation function using, for example, 4 points in the vicinity thereof, that is, a function for generating a data that does not actually exist by using data at 4 points in the vicinity. By the use of the interpolation function based on these 4 points in the vicinity, the average value over the extent as broad as possible in the vicinity of the pixel point of sampling can be calculated.

The data obtained as a result of sampling by the sampling circuit 26 is supplied to the summation data detection circuit 27. The summation data detection circuit 27, likewise in the case of the first embodiment of the present invention, latches sampled data, summates the data corresponding to the 16 points, thereby detecting the summation data corresponding to one field (one frame), then supplies the summation data detected to the panel control circuit 24.

The panel control circuit 24, which, likewise in the case of the first embodiment of the present invention, has a built-in lookup table (LUT) 24A for converting the summation data corresponding to one field to the luminescing period, controls in such a way that, by scanning respective luminescent pixels in the organic EL panel 21 sequentially row by row, respective organic EL elements of RGB in a luminescent pixel thus selected is caused to be driven at a respective drive current corresponding to a signal level of digital RGB signals, and controls such that each luminescing period of a respective organic EL element is determined by referring to the lookup table 24A based on the summation data corresponding to one field supplied from the summation data detection circuit 27.

As described hereinabove, also in the organic EL display apparatus according to the second embodiment of the present invention, as the feedforward control method is adopted for controlling the luminescing periods in accordance with the signal level of the digital RGB signals which are the original source signals, the same advantages and effects as in the case of the organic EL display apparatus according to the first embodiment can be achieved. In addition to the above, because the digital RGB signals inputted to the panel control circuit 24 are used as the original source signal, whatever types of signals are to be inputted to the display apparatus of the present invention, its control is enabled.

Third Embodiment

Figure 6:
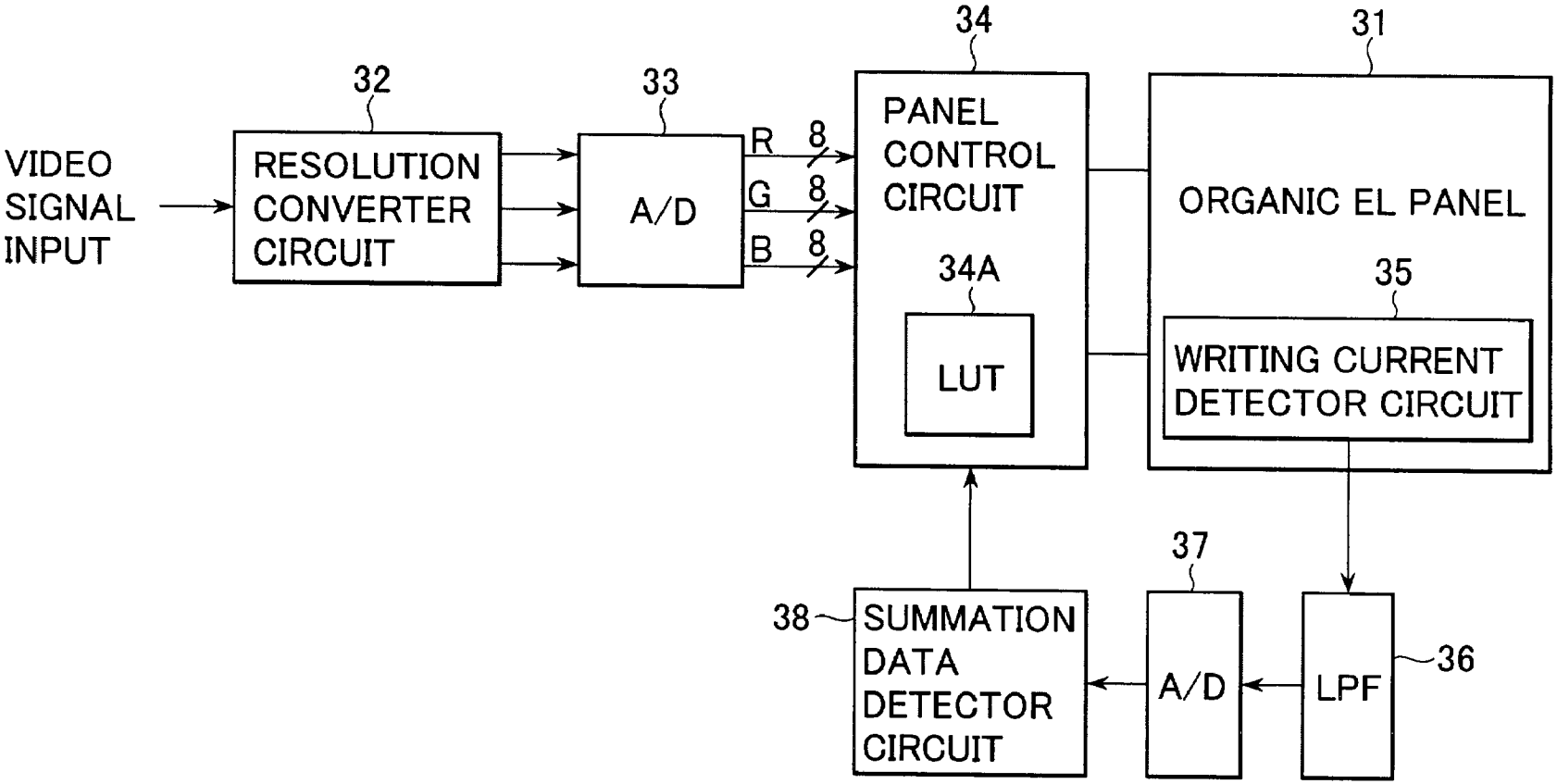
FIG. 6 is a block diagram depicting an exemplary configuration of an organic EL display apparatus according to a third embodiment of the present invention.

FIG. 6 is a block diagram indicating a schematic arrangement of an organic EL display apparatus according to the third preferred embodiment of the present invention.

As clearly indicated in FIG. 6, the organic EL display apparatus according to the third embodiment of the present invention is configured to include an organic EL panel 31, a resolution conversion circuit 32, an A/D conversion circuit 33, a panel control circuit 34, a writing current detection circuit 35, an LPF 36, an A/D conversion circuit 37, and a summation data detection circuit 38. By way of example, as for the summation data detection circuit 38, it may be integrated into the panel control circuit 34 so that the panel control circuit 34 has the function of the summation data detection circuit 38.

The organic EL panel 31, likewise the organic EL panel 11 in the organic EL display apparatus according to the first embodiment of the present invention, is configured to include a plurality of pixel circuits, each containing respective organic EL elements, arranged in a matrix form on a substrate such as a transparent glass. An example of a specific configuration of the pixel circuit is shown in FIG. 7.

Figure 7:
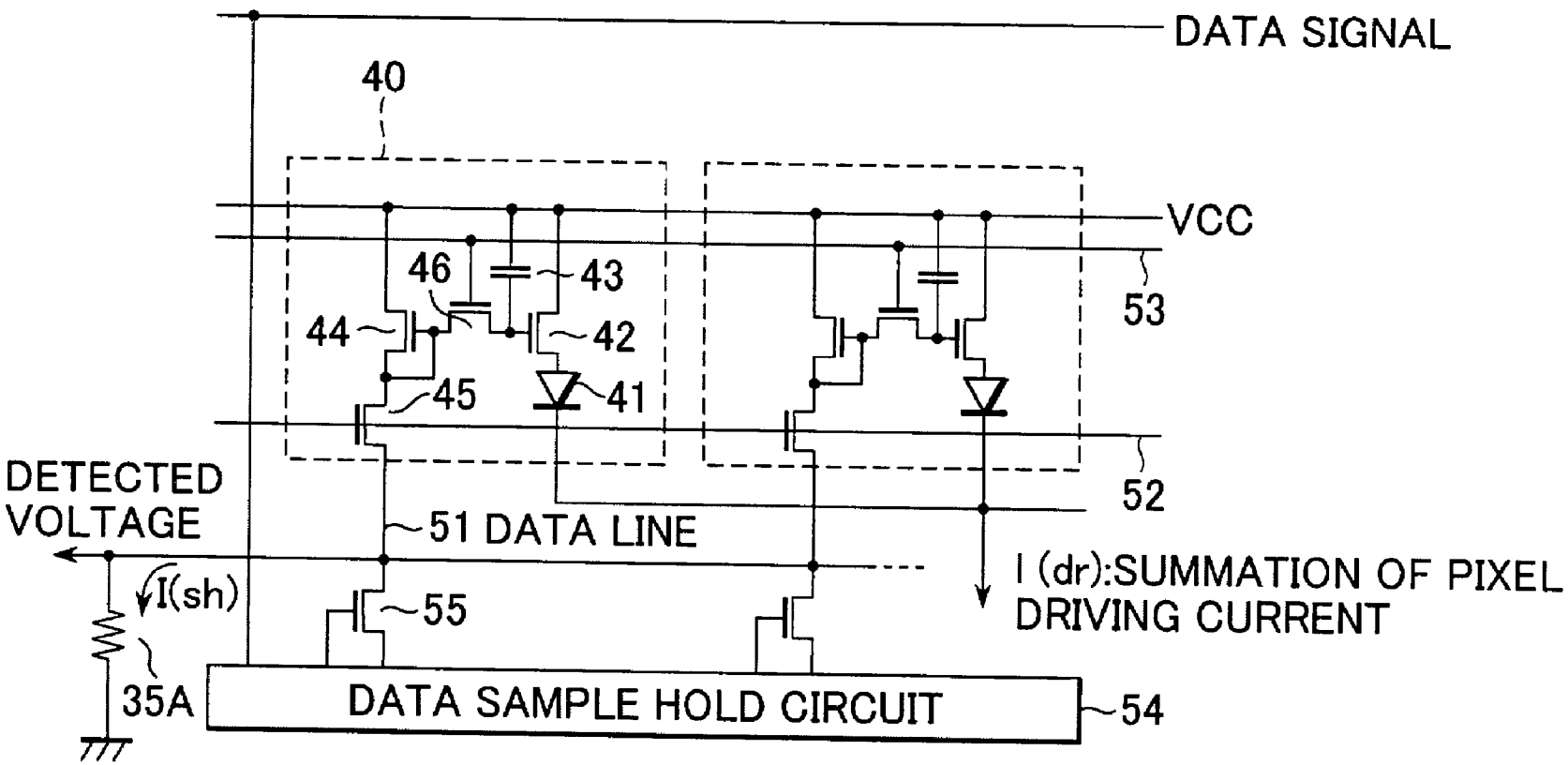
FIG. 7 is a circuit diagram depicting more in detail an exemplary configuration of a pixel circuit of the present invention.

By referring to FIG. 7, organic EL elements 41 have, for example, cathodes that are connected together among other pixels by each row. Between anodes of the each organic EL element 41 and a power source VCC, there is connected an EL driving FET 42 for providing a drive current through the organic EL element 41. Between the gate of the EL driving FET 42 and the power source VCC, there is connected a capacitor 43. This capacitor 43 holds a voltage (luminance information) for driving the EL drive FET 42.

Between the power source VCC and a data line 51, there are connected in series a data write FET 44 and a vertical selection FET 45. The data write FET 44 that has a diode connection arrangement in which the gate and the drain thereof are connected together and converts (transforms) a writing current supplied via the data line 51 to a voltage. Further, the data write FET 44 has a configuration of a current mirror circuit in conjunction with the EL drive FET 42 by connecting the gate and the drain thereof to the gate of the EL drive FET 42 via the luminescing period control FET 46.

The gate of the respective vertical selection FET 45 is connected to a vertical selection line 52 row by row, and upon application of a vertical scan pulse from the panel control circuit 34 via the vertical selection line 52 corresponding thereto, respective pixels are selected per row. The gate of the respective luminescing period control FET 46 is connected to a luminescing period control line 53 per row, and by holding an on-state (conducting state) while a luminescing period set-up signal is given from the panel control circuit 34 via the luminescing period control line 53, the luminescing period of the respective organic EL element 41 is controlled.

The pixel circuit 40 is constructed as described above. By arranging a plurality of these pixel circuits 40 in a matrix form, the organic EL panel 31 is constructed. The data line 51 is supplied with data in a form of a current from a sample hold circuit 54 via a horizontal selection FET 55. To the gate of the respective horizontal selection FET 55, a horizontal scan pulse is given sequentially within one horizontal scan period from the sample hold circuit 54, thereby supplying the data to the respective pixel circuit 40 described above.

Now, again referring to FIG. 6, the resolution conversion circuit 32 is inputted with an analog video signal. This analog video signal, after subjected to a resolution conversion processing in the resolution conversion circuit 32 so as to conform to the resolution of the organic EL panel 31, is converted to digital RGB signals, for example, of 8 bits in the A/D conversion circuit 33, then supplied to the panel control circuit 34.

The writing current detection circuit 35, which is configured to include a current detection resistance 35A connected between the respective data line 51 on the organic EL panel 31 and the ground, detects a writing current flowing through the data write FET 44 in each pixel circuit 40, and transforms the same into a voltage. The detected voltage corresponding to this writing current is supplied as the original source signal for driving the luminescent pixels to the LPF 36 that is placed outside the panel. The LPF 36 filters high frequency components in the detected voltage, and supplies to the A/D conversion circuit 37.

In the A/D conversion circuit 37, likewise in the case of the first embodiment, sampling is taken four times in one horizontal scan period, then, the sampling in the horizontal scan direction is executed in repetition, for example, at four points in the vertical scan direction so that 16 times of samplings are taken within a data corresponding to one field (one frame). However, the sampling method in the A/D conversion circuit 37, i.e., 16 times of samplings within one field period, is only one example, therefore, the number of samplings may be increased or reduced. With an increasing number of samplings, finer control may be executed.

The sampling data in the A/D conversion circuit 37 is supplied to the summation data detection circuit 38. The summation data detection circuit 38 latches the sampling data from the A/D conversion circuit 37, summates the data between the vertical synchronous pulses (V-Sync), i.e., the data corresponding to 16 points in one field, thereby detecting a summation pixel data writing current corresponding to one field (one frame), and supplies the detected summation pixel data writing current to the panel control circuit 34.

The panel control circuit 34, by scanning respective luminescent pixels in the organic EL panel 31 sequentially row by row, controls for respective organic EL elements of RGB in a thus selected luminescent pixel to be flown with a drive current therethrough in accordance with a signal level of digital RGB signals supplied from the A/D conversion circuit 33, and also controls for a respective luminescing time period of a respective organic EL element 41 to be determined on the basis of the summation data corresponding to the one field supplied from the summation data detection circuit 38.

As described hereinabove, also in the organic EL display apparatus according to the third embodiment of the present invention, the feedforward type control method is adopted for controlling the luminescing period on the basis of the pixel data writing current which is the original source signal. Accordingly, likewise in the case of the organic EL display apparatus according to the first embodiment, mutually contradicting conditions for improving the contrast and reducing the power consumption have been achieved together without relying on the property of the organic EL elements. In addition, a least delay control is realized, and also, the luminescing period is controlled appropriately without being influenced by distinctive properties such as luminous efficiencies or the like of the respective organic EL elements of RGB.

As described heretofore, according to the present invention, because that the signal level of the original source signals that drive the luminescent pixels is detected, and respective luminescing periods of the luminescent pixels are controlled in accordance with the detected signal level, a significantly improved contrast and a reduced power consumption can be achieved without being affected by the respective properties of the organic EL elements. In addition thereto, because of the feedforward control method thereof, a minimum delay control is realized, and also respective luminescing periods of respective luminescent pixels is controlled appropriately without being affected by distinct properties such as luminous efficiencies of respective luminescing elements of RGB.

Finally, the embodiments and examples described above are only examples of the present invention. It should be noted that the present invention is not restricted only to such embodiments and examples, and various modifications, combinations and sub-combinations in accordance with its design or the like may be made without departing from the scope of the present invention.

What is claimed is:

1. An organic electroluminescence display apparatus comprising:

summation data detection means for generating a summation signal level of an original source signal that is a source signal for driving luminescent pixels, and panel control means controlling a luminescing time period of said luminescent pixel in accordance with said generated summation signal level, said summation signal level corresponding to one field period, wherein said panel control means comprises a lookup table for mapping the summation signal level, to a luminescing time period, and said panel control means determines a luminescing time period of said luminescent pixels in accordance with said summation signal level by referring to said lookup table.

2. An organic electroluminescence display apparatus comprising:

summation data detection means for generating a summation signal level of an original source signal that is a source signal for driving luminescent pixels, and panel control means controlling a luminescing time period of said luminescent pixel in accordance with said generated summation signal level, said summation signal level corresponding to one field period, wherein said summation data detection means determines said summation signal level corresponding to one frame period by sampling a signal level of said original source signal at a plurality of time points in one field period.

3. The organic electroluminescence display apparatus as claimed in claim 1 or 2, wherein said original source signal is analog RGB signals, and said summation data detection means generates said summation signal level by compositing signal levels of said analog RGB signals.

4. The organic electroluminescence display apparatus as claimed in claim 1 or 2, wherein said original source signal is digital RGB signals, and said summation data detection means generates summation data by compositing signal levels of said digital RGB signals.

5. The organic electroluminescence display apparatus as claimed in claim 1 or 2, further comprising:

pixel circuits respectively containing said luminescent pixel, wherein said pixel circuit comprises a write transistor for converting a write current supplied via a data line to a voltage, and a drive transistor for driving said luminescent pixel in accordance with said voltage converted by said write transistor, and wherein said original source signal is said write current flowing through said write transistor.

6. A method of controlling an organic electroluminescence display apparatus comprising:

a summation data detection step for generating a summation signal level of an original source signal that is a source signal to for driving a luminescent pixel; and a panel control step for controlling a luminescing period of said luminescent pixel in accordance with said generated summation signal level, said summation signal level corresponding to one field period, wherein in said panel control step, said luminescing period of said luminescent pixel is determined by referring to a lookup table, said lookup table being provided for mapping summation signal levels, corresponding to one field period, to luminescing periods.

7. A method of controlling an organic electroluminescence display apparatus comprising:

summation data detection step for generating a summation signal level of an original source signal that is a source signal for driving luminescent pixel; and a panel control step for controlling a luminescing period of said luminescent pixel in accordance with said generated summation signal level, said summation signal level corresponding to one field period, wherein a signal level of said original source signal is sampled at a plurality of time points in one field period, and said summation signal level corresponding to one frame period is determined based on the signal levels sampled.

* * * * *